United States Patent [19]

Eloranta

[11] 4,054,231

[45] Oct. 18, 1977

[54] PHOTOGRAPHIC APPARATUS

[75] Inventor: Vaito K. Eloranta, Needham, Mass.

[73] Assignee: Polaroid Corporation, Cambridge, Mass.

[21] Appl. No.: 680,748

[22] Filed: Apr. 27, 1976

[51] Int. Cl.[2] ..... B65D 35/28; F04B 43/12

[52] U.S. Cl. ..... 222/102; 222/207; 354/304; 417/476

[58] Field of Search ..... 222/92–107, 222/214, 207; 354/303, 304; 239/327, 328; 401/152–154, 158, 161, 169, 183; 417/475–477

[56] References Cited

U.S. PATENT DOCUMENTS

| | | | |
|---|---|---|---|
| 401,950 | 4/1889 | Haussmann | 417/476 X |
| 1,731,703 | 10/1929 | Bourke | 222/99 |
| 1,760,773 | 5/1930 | Penney | 222/99 |
| 2,361,647 | 10/1944 | Nyden | 222/214 |
| 2,723,779 | 1/1955 | Parker et al. | 222/104 |
| 2,797,625 | 7/1957 | Fairbank | 222/207 X |
| 2,880,913 | 4/1959 | Peyron | 222/214 |
| 3,134,317 | 5/1964 | Land | 354/303 |
| 3,186,324 | 6/1965 | Eloranta | 222/214 X |
| 3,194,452 | 7/1965 | Sanderford | 417/476 X |

*Primary Examiner*—Robert B. Reeves
*Assistant Examiner*—Fred A. Silverberg
*Attorney, Agent, or Firm*—John W. Ericson

[57] ABSTRACT

Apparatus for distributing processing fluid across a sheet of photographic material to facilitate the distribution of the fluid between that sheet and another sheet. The processing fluid is contained in one or more elongated flexible tubes, each provided at one end with a flow control nozzle and provided with flow control stops spaced by a predetermined length of the tubing to facilitate deposition of the fluid in a defined path across the sheet.

4 Claims, 8 Drawing Figures

PHOTOGRAPHIC APPARATUS

This invention relates to photography, and particularly to novel apparatus for treating photographic materials with a fluid.

Photographic processes are well known in which a pair of sheets of photographic material are brought together and passes through a pair of processing rolls while a supply of processing fluid is fed between them and thus into the permanent or temporary laminate formed from the sheets by the rolls. In conventional processes of this kind, it is frequently desired to make a photographic exposure on one of the sheets, and then immediately to distribute fluid in a path between the sheets ahead of the processing rolls, whereupon the rolls are driven to process the image to produce the exposed photographic material to produce a finished print by passing the sheets between the rolls.

One form of apparatus that has been developed for the introduction of fluid in this manner is in the form of an elongated flexible tube or pod containing a supply of the fluid. The tube is initially closed at both ends. The tube is introduced between the sheets just ahead of the rolls, and at the desired time, one end is opened and the tube is pulled through a press and across the sheets from the other end, so that the processing fluid is forced out in a stream across the sheet to be treated. Apparatus for this purpose is shown and described, for example, in U.S. Pat. No. 3,047,387, granted on July 31, 1962 to Edwin H. Land for "Photographic Processes, Products and Devices," and in U.S. Pat. No. 3,186,324 granted to Vaito K. Eloranta on June 1, 1965 for "Photographic Apparatus," both of said patents being assigned to the assignee of this application.

The apparatus and processes described in the cited patents are capable of producing photographic prints of high quality for most photographic purposes, which normally do not require prints larger, for example, than 4 × 5 inches. Larger prints are, of course, made either by a conventional process of enlargement or in view cameras of 5 × 7 inches or 8 × 10 inches format.

The object of this invention is to facilitate the production of high quality prints for very large formats, including prints that are several feet in each dimension.

The problems in processing very large photographic sheets by the methods formerly employed relate to the difficulty of metering large quantities of processing fluids of conventionally moderate viscosity, both with accuracy and without spilling quantities of the fluid over the edges of the sheets and thus contaminating the camera and related equipment. This problem is exacerbated when it is desired to make prints that are both very long as well as wide. The use of tubular pods, of the type disclosed in the above-cited patents, of sufficient diameter to enclose enough fluid for a large print of the kind here contemplated would result in the fluid simply spilling out of the open end of the tube when the end is first opened, rather than being gradually extruded out as the tube is withdrawn through the press as described in the patents.

Briefly, the objects of this invention are attained by a novel pod construction in which processing fluid is contained in an elongated flexible tube which is provided at one end with a flow control nozzle that is initially closed by a plug. The other end of the tube is closed by a plug which protrudes from the tube and also serves as a handle for manipulating the pod. This plug further cooperates with an extrusion press in a manner to be described to determine the starting point for the deposition of fluid from the tube. The end point for the deposition of the fluid on the sheet to which the fluid is applied is determined by a ferrule located intermediate the ends of the tube. When this ferrule encounters the extrusion press, resistance to further passage of the tube through the press is detected, either manually or by other means to be described, and the deposition process is then terminated at the desired location on the sheet.

Preferably, the pod is slidably mounted in a guide rack that holds it just above the sheet to be treated so that it is guided accurately across the sheet when it is withdrawn through the press. For very large prints, for example, prints of 3 feet by 7 feet in dimensions, it is preferred to employ a plurality of pods of the kind just described, mounted in spaced parallel relationship in a guide rack that performs the same function as just described. For this purpose, it is preferred to provide apparatus for mechanically withdrawing all of the pods through the press at the same time, so that more rapid and uniform deposition of the desired quantity of processing fluid is accomplished. The use of a plurality of pods further simplifies the process of extruding fluid of moderate viscosity without spilling it when very large quantities are to be dispensed.

The apparatus of the invention, and the manner in which it is preferred to carry it out, will best be understood in the light of the following detailed description, together with the accompanying drawings, of an illustrative emobidment of the invention.

Figure 1:
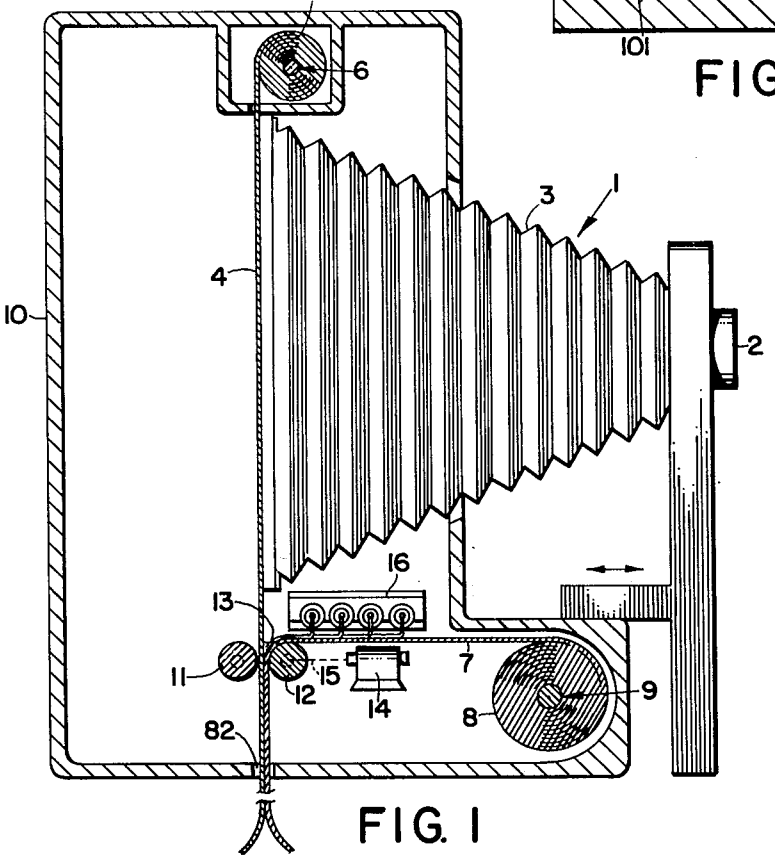
FIG. 1 is a schematic and fragmentary sketch illustrating apparatus in accordance with the invention in its functional relationship to a camera.

Referring to FIG. 1, there is shown a camera generally designated 1, the constructional details of which may be conventional, except in the respects to be described. For example, a conventional process camera can be modified for use in the practice of the invention. For very large prints, such as the 3 feet by 7 feet prints described above, it may be desired to construct the camera as a portable work room, with a door for the entry and egress of operators before or during the photographic process. In any event, the camera is to be provided with any conventional lens as suggested at 2, of suitable focal length and field angle, adjustably mounted relative to an exposure plane by means suggested as a bellows 3, so as to form a focused image of a desired subject on a selected region of a photographic negative sheet 4.

The sheet 4 may be provided in the form of a roll suggested at 5, suitably journalled for rotation in the housing of the apparatus as indicated at 6. A cooperating receiving sheet 7 may similarly be obtained from a roll 8 journalled for rotation in the housing of the apparatus as suggested at 9. As indicated, a light-tight housing 10 is completed about this portion of the apparatus in any conventional manner. A pair of processing rolls 11 and 12 are journalled in the housing of the apparatus in any conventional manner, and serve to bring the sheets 4 and 7 together while distributing processing composition 13 between the sheets in a manner to be described. For this purpose, the processing roll 12 is preferably arranged to be driven by a conventional motor 14 through intermediate drive means of a conventional nature suggested at 15.

Figure 2:
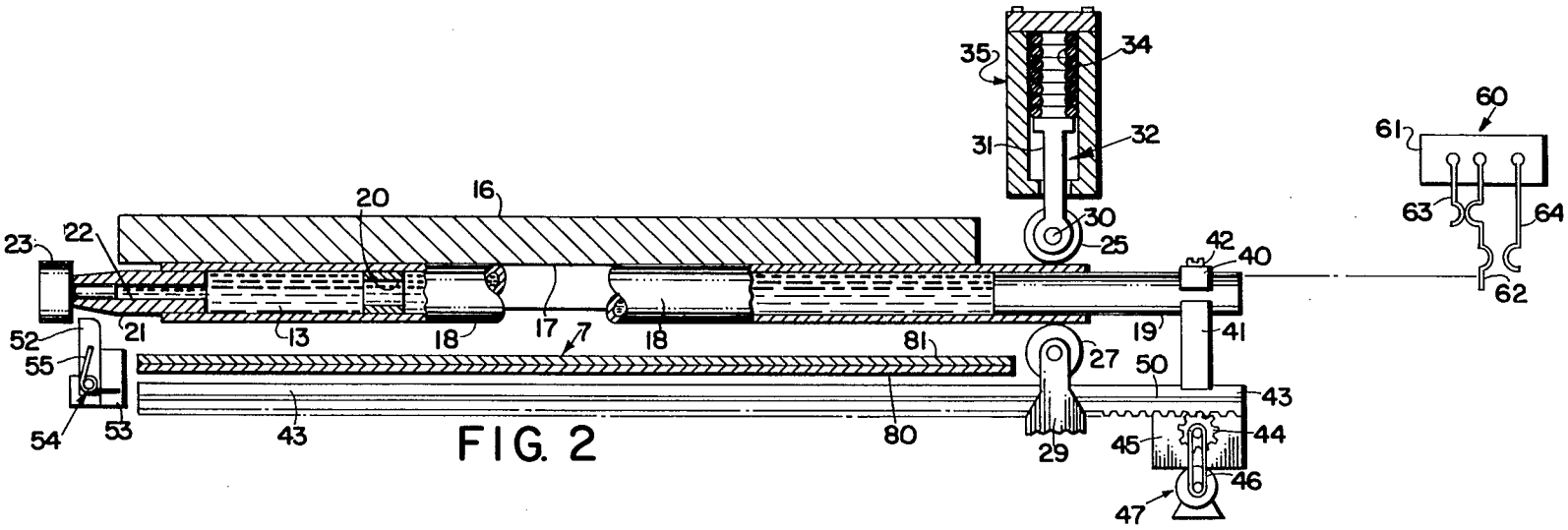
FIG. 2 is a schematic fragmentary elevational sketch, with parts shown in cross section and parts broken away, and on an enlarged scale, taken substantially along the lines 2—2 in FIG. 2 and illustrating a portion of the apparatus in more detail.
Figure 3:
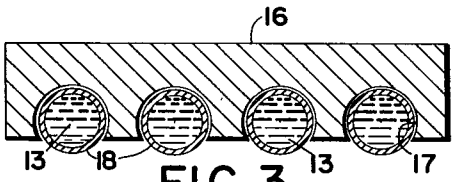
FIG. 3 is a schematic cross-sectional view of a portion of the apparatus of FIGS. 1 and 2, taken substantially along the lines 3—3 in FIG. 2.
Figure 5:
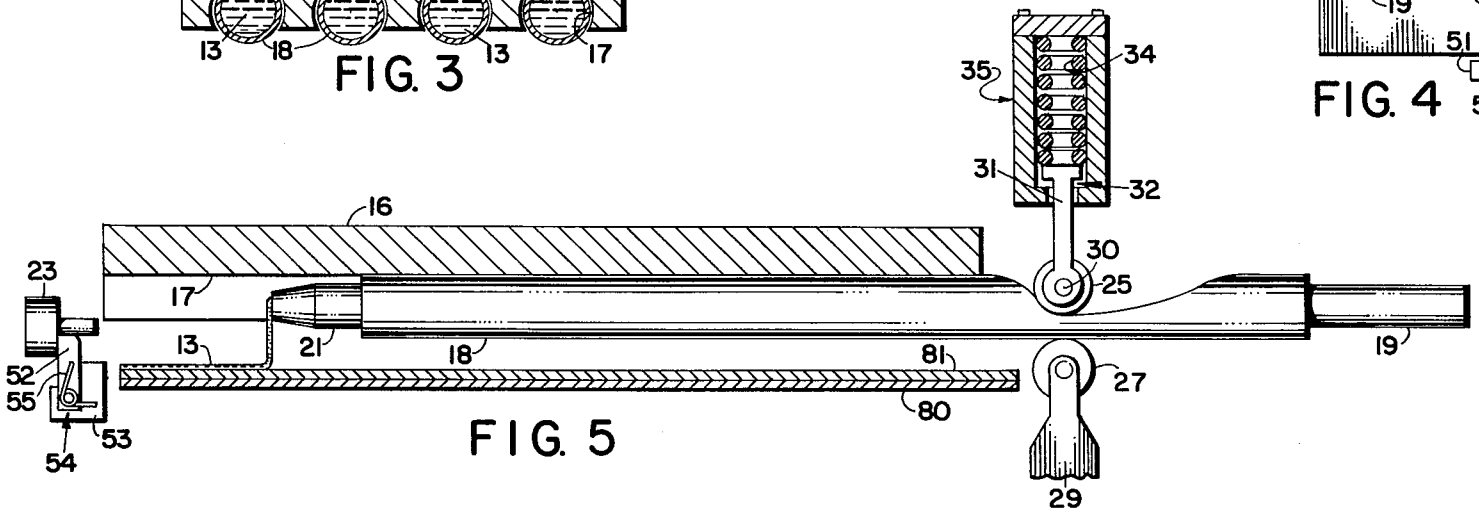
FIG. 5 is a schematic fragmentary sketch, with parts in cross section, parts omitted and parts broken away, of the apparatus of FIG. 2 showing the parts in another position assumed during the operation of the apparatus.

Fixed in the housing above the sheet 7 and adjacent the bite of the rolls 11 and 12 is a rack 16 of any suitable material, such as wood, metal, plastic, or the like, which is provided with four parallel guide grooves 17, as better seen, for example, in FIG. 3 and 5. In these grooves are initially disposed four dispensing tubes or pods 18, each initially filled with a supply of the processing composition 13, as indicated in FIGS. 2 and 3.

The tubes 18 may be of any suitable flexible metal or plastic material, but are preferably of a heat shrink plastic material to facilitate assembly. In particular, each tube 18 is closed at one end by a plug 19 of any suitable liquid impervious material that will not be attached by, or react with, the processing fluid, and this plug 19 is preferably installed by sliding it into the tube 18 and then shrinking the tube 18 locally down on it to form a seal by applying heat. A ferrule 20 is installed in each tube 18 by the same process. The ferrule 20 may be of any relatively hard material such as metal, plastic or the like which will not be attacked by, or react with, the processing composition.

The tubes 18 are then each filled with a processing composition 13. If the processing composition is sufficiently viscous to make it desirable, the plugs 19 may be bored to facilitate filling the tubes after they are installed, and the bores then plugged in any suitable way.

Means forming a flow control orifice, here shown as a nozzle 21, is installed in the filled tube. The nozzle 21 is formed with a metering aperture 22 that is next temporarily sealed off with a plug 23. The nozzle 21 and plug 23 may be chosen from the same types of materials as the rods 19 and ferrules 20.

The basic functions of the guide rack are to keep the tubes in line as they are withdrawn, and to hold the tubes out of contact with the receiving sheet. The principal functions of the nozzle 21 are to avoid spilling, and to keep processing fluid from contacting the sides or edges of the guide grooves 17.

Referring to FIGS. 1 and 2, the filled tubes 18 made up as just described are initially positioned in the apparatus with portions of the rods 19 within an extrusion press comprising an upper roll 25 and a lower roll 27. The roll 27 is mounted on a shaft 28. The shaft 28 is journalled in suitable supports 29 fixed to the housing.

The roll 25 is mounted on a shaft 30 journalled to the arms such as 31 of a yoke generally designated 30. The crossbar 33 of the yoke 32 is urged downwardly by coil springs such as 34 in a frame 35. The frame 35 is fixed to the housing of the apparatus in any conventional manner. By the arrangement just described, the roll 25 is normally urged down towards the fixed roll 27 with a force sufficient to collapse the tubes 18 except in the vicinity of the plugs 19 and the ferrules 20, when the plugs 23 are removed in the manner to be described.

Figure 4:
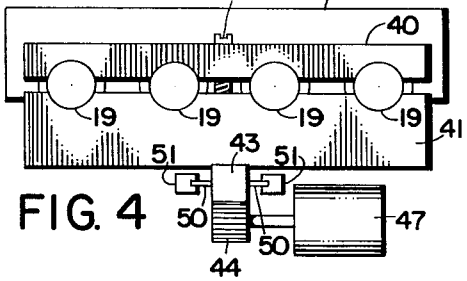
FIG. 4 is a fragmentary end elevation of a portion of the apparatus of FIG. 2, taken substantially along the lines 4—4 in FIG. 2.

The four pods shown in the illustrative embodiment of the invention are preferably withdrawn fairly rapidly, though not so rapidly that the fluid spurts beyond the desired zone of deposition, and all at the same time. For this purpose, and particularly for very large formats, it is preferred to employ a drive system including a motor. For this purpose, comparing FIGS. 2 and 4, the four ferrules 19 of the installed pods are grapsed by a clamping comprising an upper portion 40 detachably secured to a lower portion 41 by suitable means here shown as a bolt 42 passing through a suitable aperture formed in the block 40 into threaded engagement with a threaded aperture in the block 41.

The block 41 is secured in any suitable manner, as by welding or the like, to a rack 43 adapted to be driven by a pinion 44 journalled in a suitable support 45. The pinion 44 is arranged to be driven by a slip clutch, here shown as a flexible belt 46 of polyurethane or the like. The belt 46 is in turn driven by a conventional electric motor 47 mounted on the frame of the apparatus. As suggested in FIG. 4, the rack 44 may be formed at its sides with guide rails 50 slidable in ways 51. The ways 51 are in turn secured to the housing.

To prepare the apparatus for use with the parts in the position shown in FIG. 2, the upper press roll 25 may be temporarily blocked up in any convenient manner to allow the passage of the tubes 18. The tubes 18 are inserted in the grooves 17 formed in the block 16, and pushed along until they are in the position shown. The plugs 23 may be manually removed at the appropriate time. However, as here shown, means for detaching them automatically is provided in the form of a latch bar 52 pivoted to a suitable support 53 suggested at 54 and biased into the position shown by a spring 55. As the tubes 18 are moved into position, the latch 52 will be swung counterclockwise as seen in FIG. 2 by the ends of the plugs 23, which will then pass over the apparatus into the position shown in FIG. 2. When the pods are subsequently withdrawn, as suggested in FIG. 5, the plugs 23 will be stopped by the latch bar 52 and knocked off, where they can fall down into any convenient region provided for later removal by an operator.

A limit switch generally designated 60, and shown in FIG. 2 considerably to the left of the position in which it would be placed in practice, is arranged to be engaged by the end of one of the plugs 19 as the latter approach the end of their withdrawal in the manner to be described. The switch 60 comprises a frame 61 secured to the housing of the apparatus and three contacts 62, 63 and 64. The contact 62 comprises an armature that is normally engaged with the contact 63, and is driven out of engagement with the contact 64 as the pods approach the end of their stroke. The function of these contacts will be described below.

Figure 6:
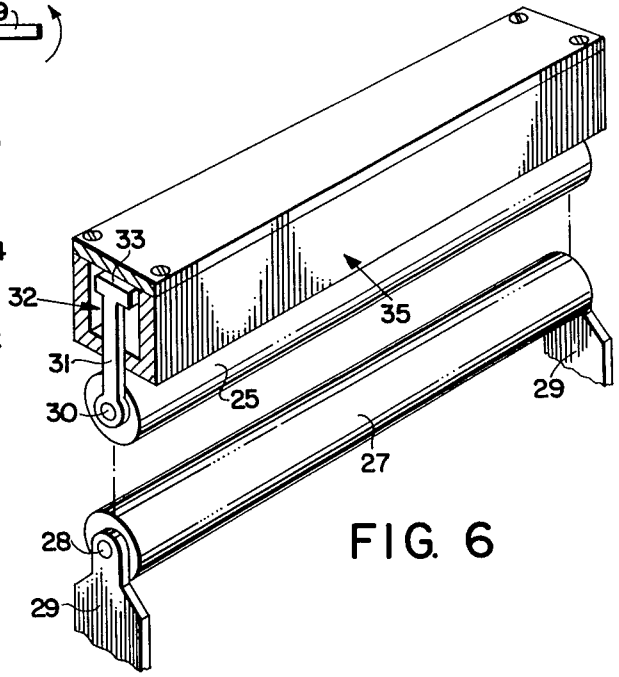
FIG. 6 is a schematic perspective fragmentary sketch of a portion of the apparatus of FIG. 2, showing processing rolls in accordance with the invention in more detail.
Figure 7:
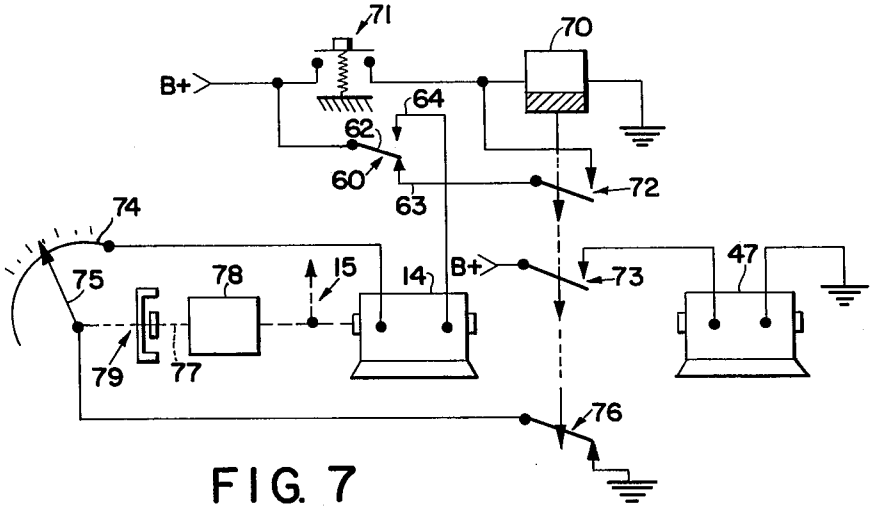
FIG. 7 is a schematic wiring diagram of drive apparatus for use in the processing apparatus of FIGS. 1–6.

FIG. 7 shows a control system for use with the apparatus of FIGS. 1–6. The apparatus is shown as powered by any convenient DC power source having terminals labeled B+ and ground. The apparatus includes a conventional slow release relay 70 having an energizing circuit completed at times over the contacts of a normally open spring-returned push button switch 71, and extending from the supply terminal at B+, over the contacts of the switch 71, and thence through the winding of the relay 70 to ground. With the limit switch 60 is the position shown in FIG. 2, a holding circuit for the relay 70 is completed once the relay is energized by a circuit extending from the supply terminal at B+, over the contacts 62 and 63 of the switch 60, and over the closed front contacts 72 of the relay 70, and thence through the winding of the relay to ground.

When the relay is energized, an energizing circuit for the motor 47 is completed over front contacts 73 of the relay 70.

An energizing circuit for the motor 14 is at times completed over a circuit extending from the supply terminal at B+ and over contacts 62 and 64 in the actuated position of the switch 60, through the winding of the motor 14, over an arcuate contact 74 forming a part of the sheet metering apparatus to be described, over a wiper 75 slidable on the contact 74, and then over back contacts 76 of the relay 70 to ground. The back contacts 76 of the relay 70 are closed when the relay is de-energized, as shown.

As schematically indicated in FIG. 7, in addition to driving the roll 11 in FIG. 1 by means schematically indicated at 15, the motor 14 is also arranged to drive the output shaft 77 of a reduction gear 78 at a conveniently low speed such that one revolution of the shaft 77 will correspond to more than the number of revolutions of the roll 11 that will be required in processing a single print. The shaft 77 is arranged to rotate the wiper 75 over the contact 74 through a conventional slip clutch 79.

The wiper 75 rotates in the direction of the arrow when the motor 14 is running, such that it will move off the contact 74 and break the motor circuit when the appropriate length of sheet material has been processed.

The photographic sheet materials and processing composition employed in the practice of this invention may be of the kinds described in the above-cited U.S. patents. As an illustration of suitable materials for the practice of the invention, mention may be made of sheet material such as used in Polacolor 2 film units, as made and sold by Polaroid Corporation of Cambridge, Massachusetts, and the processing composition used for that film. The processing composition is of the type comprising an aqueous alkaline solution containing a polymeric thickening agent to impart a viscosity in excess of 10,000 cps; e.g., in the range of from 10,000 to 200,000 cps. Typical thickening agents for this purpose are carboxymethyl cellulose, hydroxyethyl cellulose, and hydroxyethyl carboxymethyl cellulose. The processes involved are disclosed, for example, in U.S. Pat. No. 2,983,606, issued on May 9, 1961 to Howard G. Rogers and assigned to the assignee of the application.

Referring to FIG. 1, with the materials just described, the receiving sheet 7 is opaque on the side that is down as is seen passing over the motor 14 in FIG. 1, and has receiving strata on the upper side as seen in that position upon which a positive color print is formed upon the passage through the rolls 11 and 12. The negative sheet 4 is opaque on the side shown to the left in FIG. 1, and has a photosensitive surface on the righthand side. Referring to FIG. 2, the receiving sheet 7 is schematically indicated as an opaque support 80 and an image layer 81.

By this arrangement, the sheets 4 and 7 with the intermediate layer of processing composition 13 may be fed out of the camera out into a lighted space, as through an aperture 82 in the wall of the housing 10, whereupon after the desired period of imbibition, the layers may be separated. The adherance of the coating composition perferably is greater to the sheet 4 than to the sheet 7, such that the processing composition will come off with the negative sheet 4 after imbibition, wherewith it can be disposed of.

Having thus described the apparatus of the invention, its operation to produce a finished print will next be discussed. It will be assumed that the pods have been loaded with processing composition and placed in the machine in the manner shown in FIG. 2 and as described above. If desired, the switch 71 may be provided with additional contacts used to operate a shutter for the lens 2, and trigger one or more electronic flash lamps. For many large cameras, it may be preferred to simply use a lens cap, which is removed before the exposure and replaced afterwards.

Whatever the method of making the exposure, after it has been made the switch 71 in FIG. 7 is momentarily depressed, causing the relay 70 to be energized and to break its back contacts 76 and close its front contacts 72 and 73. The holding circuit for the relay 70 will now be completed over contacts 62 and 63 of the relay 60 and the motor 47 will begin to run, rapidly withdrawng the pods from the apparatus and causing the processing composition 13 to be deposited on a receiving sheet 7 as suggested in FIG. 5. The compression of the tubes 18 will not begin until the pods are withdrawn to the position in which the roller 25 can go down over the ends of the rods 19. Shortly before the pods have been withdrawn sufficiently so that the ferrules 20 will block further withdrawal, the switch 60 in FIGS. 2 and 7 is actuated by one of the rods 19, disengaging contacts 62 and 63 and closing contacts 62 and 64.

Referring to FIG. 7, the disengagement of contact 63 will interrupt the holding circuit for the relay 70. After its designed time delay, which is intended to be ample to allow the engagement of the ferrules 20 against the roll 25 through the walls of the tubing 18, the relay will release. In the meantime, the ferrules 20 will stop the further withdrawal of the pods, thereby preventing further deposition of the composition 13 on the sheet 7, and the belt 46 will slip while the motor 47 continues to run until the relay 70 is released.

When the relay 70 is released, the circuit for the motor 47 will be interrupted and that motor will stop. A circuit for the motor 14 will be completed over contacts 62 and 64, the circuit controller 74 and 75, and back contacts 76 of the relay 70.

The wiper 75 of the circuit controller is initially set to a position dependent on the length of the sheet to be processed. When the predetermined amount of material has been drawn through the rolls 11 and 12, the wiper 75 will run off the contact 74 and the motor 14 will stop. The sheets 4 and 7 may then be cut off below the rolls in any convenient manner, and after the desired period of imbibition, the sheets can be separated so that the finished print is made available. The apparatus may then be restored to its initial condition manually as described above.

The number of pods employed in the practice of the invention is determined by the amount of fluid to be destributed per unit distance across the sheet. Among other factors, the amount of fluid will be proportional to the length of the sheet. It has been found that a single pod of convenient size is adequate for a 20 × 24 inch format, for example.

Desirably, the path along the sheet over which fluid is deposited begins inside one edge of the sheet on which the fluid is to be deposited, and ends short of the other edge of the sheet. This result is readily attained by the appropriate placement of the stops formed by the plug 19 and the ferrule 20 in each pod. It should be noted in this regard that the use of an excess of fluid, together with the provision of these stops to determine the amount deposited, makes it possible to deposit the same amount of fluid each time. Suction in the flattened tube prevents spilling of the excess fluid when the press is released.

Figure 8:
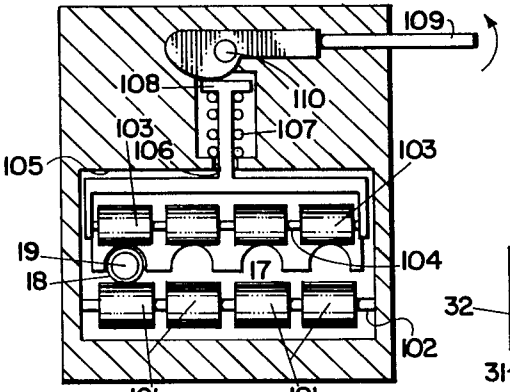
FIG. 8 is a schematic elevational sketch of a manually operable extrusion press in accordance with another embodiment of the invention.

FIG. 8 illustrates a modification of the invention adapted to manual operation. The apparatus may be as described above except that no withdrawal drive means for the pods is required, and the pods are handled one at a time.

A manually operable extrusion press is provided. This press is mounted in a frame 100, of metal or the like, in which four bottom rollers 101 are journalled for independent rotation on a shaft 102 secured in the frame 100.

Four upper rolls 103 are journalled for independent rotation on a shaft 104 fixed in a yoke 105. The yoke 105 is slidably mounted in an aperture 106 formed in the frame 100, and urged upwardly by a spring 107 acting between the frame 100 and an extension 108 formed on the yoke.

The guide block 16 with its re-entrant grooves 17 is behind the frame in the same relation to the press rolls as described above in connection with FIG. 2. One of the pods comprising a tube 18 and a plug 19 is shown in position between the rolls.

A cam 109 is journalled for rotation on the frame 100 by means shown as a pin 110. In operation, after removing the plug 23, the user grasps the pod and places it so that the plug 19 is just beyond the rolls, then rotates the cam 109 in the direction of the arrow to force down the yoke and squeeze the tube 18 flat as before. The pod is then manually withdrawn. Next, the cam 109 is moved to the position shown in FIG. 8, the pod is quickly pulled out, and a new pod is inserted in the second groove 17. These procedures are repeated until the desired portion of the contents of all four pods have been deposited, and the drive motor 14 is then operated to drive the sheets through the processing rolls. Obviously, a considerably simpler circuit may be used to control the motor 14 for this purpose.

While the invention has been described with respect to the details of particular embodiments, many changes and variations will occur to those skilled in the art upon reading this description. Such can obviously be made without departing from the scope of the invention.

What is claimed is:

1. A photographic fluid applicator adapted to cooperate with an extrusion press for dispensing a predetermined quantity of processing fluid across a sheet of photographic material, said applicator comprising an elongated flexible tube, a quantity of processing fluid greater than said predetermined quantity in said tube, a plug in a first end of said tube, said plug closing said tube and forming a stop preventing collapse of said tube when said tube is engaged by an extrusion press in a first region adjacent said first end, means forming a flow limiting orifice in a second end of said tube opposite said first end, means detachably mounted in said orifice for preventing the flow of processing fluid until detached, and stop means mounted in said tube intermediate said ends and spaced therefrom for preventing collapse of said tube by an extrusion press in a second region adjacent said second end to stop the flow of fluid from said tube when engaged by the press as said tube is drawn through the press from said first end toward said second end.

2. A photographic fluid applicator for dispensing a predetermined quantity of photographic processing fluid in a path across a sheet of photographic material, comprising an elongated tube of flexible material, means closing one end of said tube, means forming a metering orifice in the other end of said tube, a rigid ferrule in said tube intermediate and spaced from said ends, and a quantity of processing fluid in said tube greater than said predetermined quantity.

3. A photographic fluid applicator adapted to cooperate with an extrusion press for dispensing a predetermined quantity of processing fluid across a sheet of photographic material, said applicator comprising an elongated flexible tube, a quantity of processing fluid greater than said predetermined quantity in said tube, a plug in a first end of said tube, said plug closing said tube and forming a stop preventing collapse of said tube when said tube is engaged by an extrusion press in a first region adjacent said first end, and stop means mounted in said tube intermediate said first end and a second end opposite said first end and being spaced from said ends for preventing collapse of said tube by an extrusion press in a second region adjacent said second end to stop the flow of fluid from said tube when engaged by the press as said tube is drawn through the press from said first end toward said second end.

4. A photographic fluid applicator for dispensing a predetermined quantity of photographic processing fluid in a path across a sheet of photographic material, comprising an elongated tube of flexible material, means closing a first end of said tube and forming a stop preventing collapse of said tube at said first end, detachable means closing the other end of said tube, a rigid ferrule in said tube intermediate and spaced from said ends, and a quantity of photographic processing fluid in said tube greater than said predetermined quantity, in which the amount of said fluid between said first end and said ferrule is substantially equal to said predetermined quantity.

* * * * *